United States Patent [19]

Tran

[11] Patent Number: 5,017,091

[45] Date of Patent: May 21, 1991

[54] FREE STANDING BLADE FOR USE IN LOW PRESSURE STEAM TURBINE

[75] Inventor: Mank H. Tran, Orlando, Fla.

[73] Assignee: Westinghouse Electric Corp., Pittsburgh, Pa.

[21] Appl. No.: 484,760

[22] Filed: Feb. 26, 1990

[51] Int. Cl.[5] ..... F01D 5/30

[52] U.S. Cl. ..... 416/193 A; 416/219 R; 416/223 A; 29/889.21

[58] Field of Search ..... 416/193 A, 215, 218, 416/219 R, 223 R, 223 A, 243, DIG. 2, DIG. 5; 29/889.21

[56] References Cited

U.S. PATENT DOCUMENTS

| | | | |
|---|---|---|---|
| 1,719,415 | 7/1929 | Back | 416/243 X |
| 1,793,468 | 2/1931 | Densmore | 416/219 R |
| 2,861,775 | 11/1958 | Whitehead | 416/220 R |
| 3,986,793 | 10/1976 | Warner et al. | 416/193 A X |
| 4,585,395 | 4/1986 | Nourse et al. | 416/DIG. 2 X |
| 4,767,275 | 8/1988 | Brown | 416/193 A X |

FOREIGN PATENT DOCUMENTS

| | | | |
|---|---|---|---|
| 2064667 | 6/1981 | United Kingdom | 416/DIG. 2 |

*Primary Examiner*—John T. Kwon
*Assistant Examiner*—James A. Larson
*Attorney, Agent, or Firm*—K. Bach

[57] ABSTRACT

A turbine blade is designed to avoid having to machine a part of the last blade assembled in a row in order to make a fit. The location of the root pivot center was carefully selected to be located in vertical proximity to a leading edge of the platform.

7 Claims, 2 Drawing Sheets

FREE STANDING BLADE FOR USE IN LOW PRESSURE STEAM TURBINE

BACKGROUND OF THE INVENTION

Statement of Related Cases

The present invention is related to co-pending application entitled "BLADING FOR REACTION TURBINE BLADE ROW", designated U.S. Ser. No. 07/422,333, filed Oct. 16, 1989, (now pending).

FIELD OF THE INVENTION

The present invention relates generally to steam turbine blades and, more particularly to a new turbine blade design which is capable of facilitating easier assembly of the blades in a given row.

DESCRIPTION OF THE RELATED ART

In designing any blade used in a steam turbine, a number of parameters must be scrupulously considered. When designing blades for a new steam turbine, a profile developer is given certain flow field informations with which to work. The flow field determines the inlet and outlet angles for blades of a blade row (for steam passing between adjacent rotor blades of a row), gauging, and the velocity ratio, among other things. "Gauging" is the ratio of throat to pitch; "throat" is the straight line distance between the trailing edge of one rotor blade and the suction-side surface of an adjacent blade, and "pitch" is the distance between the trailing edges of adjacent rotor blades. These parameters are well known to persons of ordinary skill in the art and play an important role in the design of every new rotor blade or stationary blade.

Blade profile designers are always looking for design features which will improve or increase turbine efficiency. One major source of reduced efficiency for a low pressure turbine is attributable to blading performance. Any sudden change of radius of curvature leads to an increase of the boundary layer thickness along the blade surface. In the region of adverse pressure gradient downstream of the blade throat, the flow tends to separate from the blade surface.

Even though blade geometry is critical to turbine efficiency, meticulously calculated blade forms are sometimes altered during assembly of the blade into the turbine, particularly when the last blade is placed in a row. Normally, an interference is created between adjacent blade foil or platforms and, because of the interference, the last blade of the row is often cut to fit into the row. This will cause a difference in the throat opening formed by the last blade and the first blade in comparison to the rest of the blades in the row. With the throat made larger, the flow in the passage of the last blade will not have enough guided passage and the flow is easily separated from its convex surface.

Another problem associated with cutting the last blade to make it fit into the row is that by changing the mass and geometry of the blade, the blade will have a different natural resonant frequency from the other blades which have been tuned to fall safely between the harmonics of running speed. If the natural frequency of the altered blade falls too close to the harmonics of running speed, this will result in an adverse affect on the blade mechanical integrity.

SUMMARY OF THE INVENTION

An object of the present invention is to provide a free standing blade which is capable of improving low pressure turbine efficiency.

Another object of the present invention is to provide a free standing blade for a low pressure turbine in which a boundary layer thickness along the blade convex surface remains small, thus enhancing blading performance.

Another object of the present invention is to provide a turbine blade design which eliminates the need for machining the last blade to be fitted into a row upon assembly of blades to the rotor.

These and other objects of the invention are met by providing a turbine blade which includes an airfoil portion having a leading edge, a trailing edge, a convex surface, a concave surface, and a lower end, a platform portion having an inlet face and being formed at the lower end of the airfoil portion, a root portion extending downwardly from the platform portion and having root center line, a root pivot center and root center line radius, wherein the root pivot center is located in vertical proximity to the inlet face of the platform.

Preferably, the radius of curvature of the convex surface increases constantly from the inlet face to the trailing edge.

In another aspect of the present invention, a method of facilitating assembly of a rotor blade to a turbine rotor comprises locating the root pivot center in vertical proximity to the inlet face of the platform portion.

These and other features and advantages of the turbine blade of the present invention will become more apparent with reference to the detailed description and drawings.

DETAILED DESCRIPTION OF THE PREFERRED EMBODIMENTS

Figure 1:
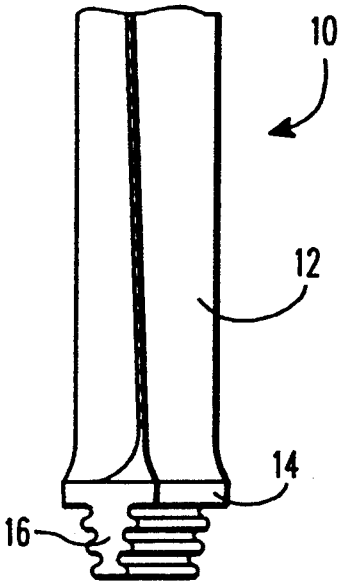
FIG. 1 PRIOR ART
FIG. 1 is a end view of a known turbine blade, showing general features thereof.
Figure 2:
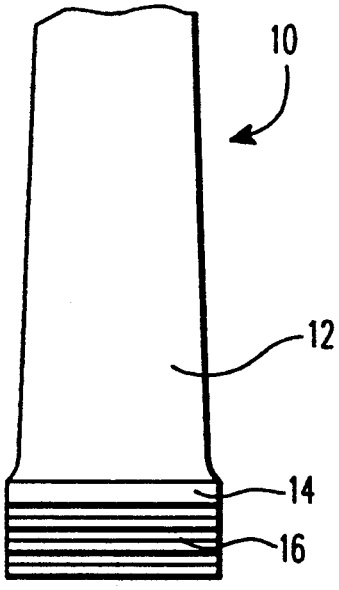
FIG. 2 PRIOR ART
FIG. 2 is a partial side elevational view of a turbine blade shown in FIG. 1.

Referring to FIGS. 1 and 2, a known turbine blade is generally referred to by the numeral 10. The turbine blade includes a airfoil portion 12, a platform portion 14 and a root portion 16. The root portion 16 is generally known as the "steeple" type root having a plurality of necks.

The root portion 16 fits into a side-entry groove of a steam turbine in a conventional fashion.

Figure 3:
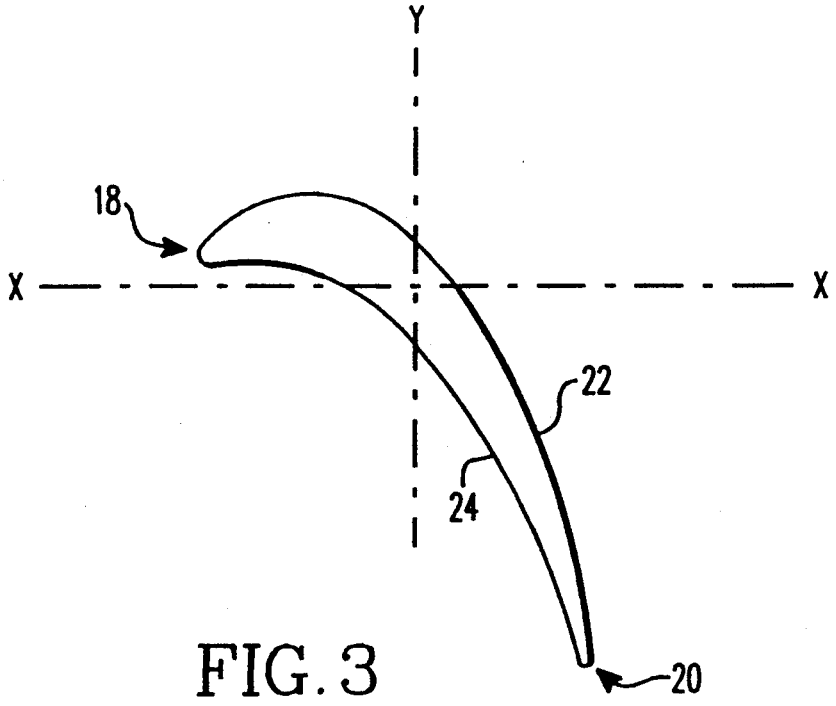
FIG. 3 is a cross-sectional view showing one section of a turbine blade according to the present invention, and showing x—x and y—y axes.

Referring now to FIG. 3, one of six basic sections of an airfoil portion of a turbine blade according to the present invention is shown on its x—x and y—y axes. The airfoil portion includes a leading edge 18, a trailing edge 20, a convex suction side surface 22 and a concave pressure side surface 24. The radius of curvature of the convex surface 22 increases constantly from the leading edge 18 to the trailing edge 20. This allows the flow to decelerate up to the blade throat and remain constant in the region downstream of the throat. This ensures a thin boundary layer on the convex surface of the blade. As previously mentioned, the blade is composed of six basic sections; all of the basic sections from the base to the tip include the design features that the radius of curvature constantly increases. Thus, the flow along the convex surface accelerates from the leading edge. With accelerating flow, the boundary layer will maintain a small thickness and the blading loss will be low.

All of the blade sections have their centers of gravity "stacked", so that the eccentric stress of the airfoil is eliminated. Also, the location of the center of gravity of the root portion is located on the x—x and y—y axes.

The blade itself is constructed by forging to protect the mechanical integrity of the blade trailing edge. The trailing edge thickness at the base section begin at 0.11 inches (2.794 millimeters) and reduces to 0.075 (1.905 millimeters) at 1.25 inches (31.75 millimeters) in blade height. Thereafter, the trailing edge thickness is 0.07 inches (1.77 millimeters).

Figure 4:
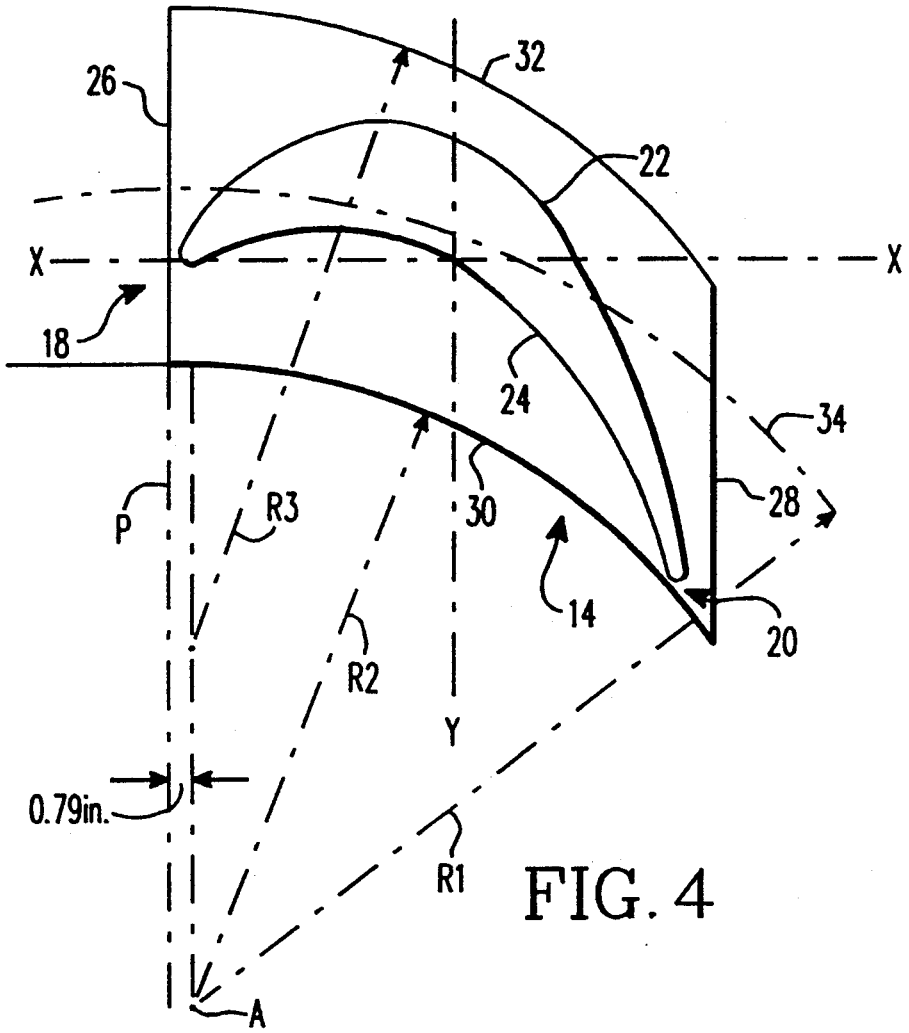
FIG. 4 is a cross-sectional view at the base section of the turbine blade according to the present invention, and illustrating the inventive points of reference.

To understand how to eliminate blade interference during the assembly of the last blade of the row, which in the past required cutting the blade to fit, reference is now made to FIG. 4, in which the lowermost section of the airfoil is shown on the platform 14. The platform 14 has a leading edge or inlet face 26 and an exit edge 28 and curved side edges 30 and 32 which have the same radius. The radius is preferably 4.15 inches (105.41 millimeters).

It was discovered by the present inventor that the location of the root pivot center determines to what extent the last blade of a row must be machined to be fitted therein. It was also determined that the proper selection of the root pivot center, in conjunction with the root center line and root center line radius, can obviate the need for final machining to fit the last blade in the row.

Accordingly, it was discovered that if the root pivot center is located at or about point A, one could eliminate the need for cutting the last blade to fit in the row. Point A is located in proximity to a plane P encompassing the inlet face 26 of the platform. In particular, point A is located point 0.79 inches (2.006 millimeters) in the x—x from the inlet face 26. This distance is substantially coincident with the distance between the inlet 18 of the airfoil portion and the inlet face 26 of the platform portion. The root center line, designated by the numeral 34, passes 0.427 inches (10.8458 millimeters) from the x—x axis at the inlet face 26 of the platform. Although this is nearly at the midway point of the platform at the inlet face, the root center line 34 passes through the exit face 28 at a greater distance below the x—x axis. Thus, the root center line 34 is somewhat asymmetric relative to the inlet face 26 and the exit face 28 of the platform.

The root center line radius R1, drawing from the pivot center A, is 5.25 inches (133.35 millimeters). The side edge 30 radius R2 has the same pivot center as the root center line, and has a length of 4.15 inches (105.41 millimeters). The opposite side edge 32 has a radius R3 of the same length, but its pivot center is 2.273 inches (57.734 2 millimeters) higher than that of the opposing side edge 30. Side edges 30 and 32 are, of course, parallel.

The root pivot center A is 4.823 inches (122.5042 millimeters) below the x—x axis, and 1.75 inches (44.45 millimeters) from the y—y axis. The ratio of distance from the y—y axis to the distance from the x—x axis for the root pivot center is thus about 0.36.

Numerous modifications and adaptations of the present invention will be apparent to those so skilled in the art and thus, it is intended by the following claims to cover all such modifications and adaptations which fall within the true spirit and scope of the invention.

I claim:

1. A turbine blade comprising:

an airfoil portion having an inlet face, a trailing edge, a convex surface, a concave surface and a lower end;

a platform portion having an inlet face and being formed at the lower end of the airfoil portion;

a root portion extending downwardly from the platform portion and having a root center line, a root pivot center and a root center line radius;

wherein the root pivot center is located in proximity to a plane encompassing the inlet face of the platform portion;

wherein relative to an x—x and y—y axis, the location of the root pivot center is defined by a ratio of distance from the y—y axis to the distance from the x—x axis, wherein the ratio is approximately 0.36.

2. A turbine blade as recited in claim 1, wherein the radius of curvature of the convex surface of the airfoil portion increases constantly from the inlet face to the trailing edge.

3. A turbine blade as recited in claim 1, wherein the airfoil portion has a plurality of sections, each having a center of gravity, wherein the centers of gravity for all of the sections are vertically stacked.

4. A turbine blade as recited in claim 1, wherein the platform has a concave side edge and wherein the concave side edge is parallel to the root center line, and has a radius of curvature with a pivot center common to the root pivot center.

5. A turbine blade as recited in claim 4, wherein the root center line has a radius of 5.25 inches, and the side edge of the platform portion facing the inlet face and trailing edge of the airfoil portion has a radius of 4.15 inches.

6. A turbine blade as recited in claim 1, wherein the inlet face of the airfoil portion and the root pivot center are approximately the same distance from the y—y axis.

7. A method of facilitating assembly of a turbine blade in a row on a turbine rotor, comprising:

locating a root pivot center of the turbine blade in proximity to a plane encompassing an inlet face of a platform portion of the turbine blade, with the root center pivot 1.75 inches from a y—y axis of the turbine blade and 4.823 inches from an x—x axis of the turbine blade.

* * * * *